United States Patent [19]

Gongwer

[11] Patent Number: 4,919,066

[45] Date of Patent: Apr. 24, 1990

[54] HYDRODYNAMIC CONFIGURATION FOR UNDERWATER VEHICLE

[75] Inventor: Calvin A. Gongwer, Glendora, Calif.

[73] Assignee: Allied-Signal, Inc., Morris Township, Morris County, N.J.

[21] Appl. No.: 298,703

[22] Filed: Jan. 19, 1989

[51] Int. Cl.[5] ..... B63G 8/08

[52] U.S. Cl. ..... 114/338; 114/20.1; 415/914

[58] Field of Search ..... 114/67 R, 67 A, 312, 114/337, 338, 20.1, 21.1, 23; 244/51, 199, 130, 204, 209, 207; 415/DIG. 1; 416/245 A

[56] References Cited

U.S. PATENT DOCUMENTS

| | | | |
|---|---|---|---|
| 2,548,905 | 4/1951 | Odenweller et al. | 114/20.1 |
| 3,066,893 | 12/1962 | Mercier | 114/20.1 |
| 3,156,207 | 11/1964 | Giles | 114/67 A |
| 3,205,846 | 9/1965 | Lang | 244/207 |
| 3,608,509 | 9/1971 | Brooks et al. | 114/23 |

*Primary Examiner*—Joseph F. Peters, Jr.
*Assistant Examiner*—Jesus D. Sotelo
*Attorney, Agent, or Firm*—Robert C. Smith; Robert A. Walsh

[57] ABSTRACT

A generally tubular-shaped or cylindrical vehicle for operation in a fluid medium is formed with a bluff or stubby afterbody and utilizes an actuator disc type propeller of approximately one-half to three-fourths of the diameter of its housing at its rear for propulsion. The propeller, in addition to driving the vehicles, is spaced from the body such that it inducts half or more of the boundary layer flow, thereby acting to draw the flow smoothly over the after part of the vehicle with a minimum of flow separation and turbulence and drag caused thereby. Steering in pitch and yaw is provided by a plurality of fins located just forward of the bluff rear surface of the vehicle. In this location the fins are more than usually effective, hence smaller than customary, because they are exposed to a fluid velocity which is near or above free stream velocity rather than at a lower velocity which is usual in vehicles having tapered afterbodies. A plurality of stator control surfaces which may be adjustable are located between the fins and the propeller and may be angled to provide a torque to counter the propeller torque or controlled for roll stabilization.

4 Claims, 1 Drawing Sheet

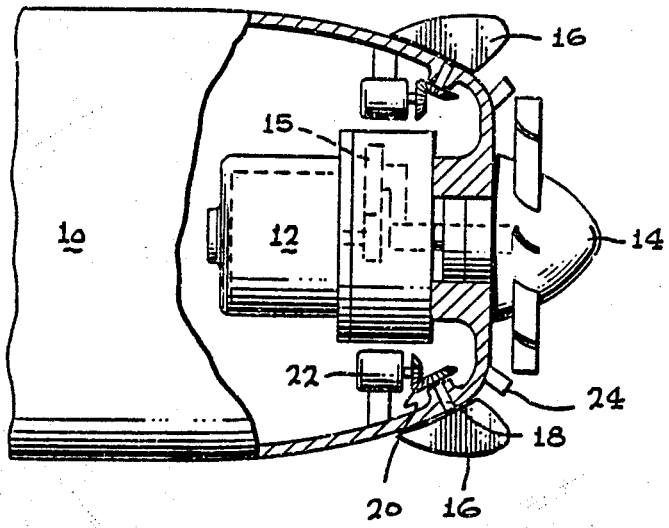
FIG. 1
FIG. 2
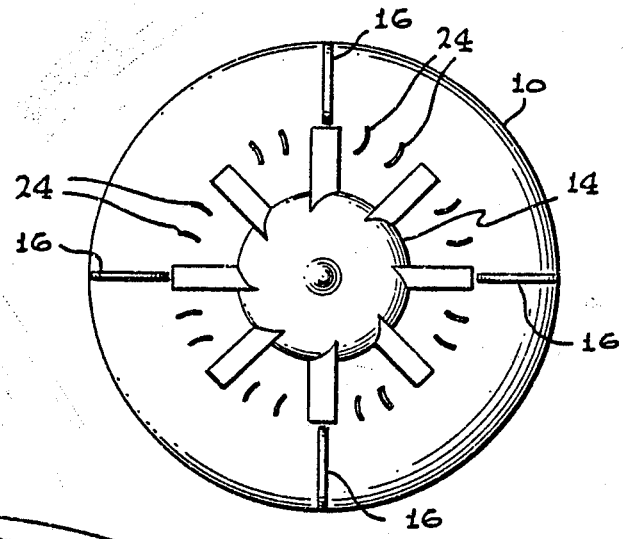
FIG. 3
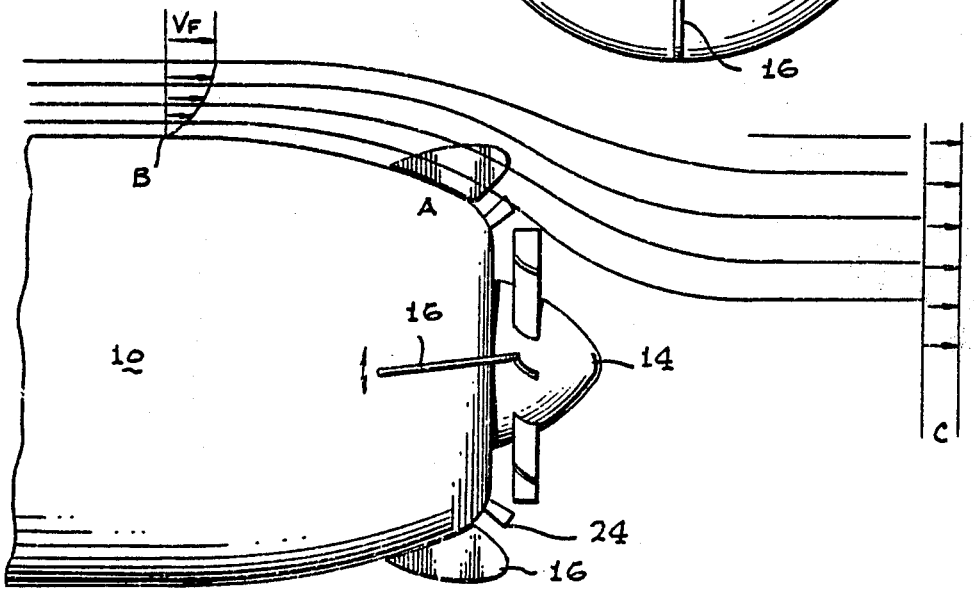

HYDRODYNAMIC CONFIGURATION FOR UNDERWATER VEHICLE

BACKGROUND OF THE INVENTION

The configuration of powered underwater vehicles has evolved through many years based on certain understood hydrodynamic and mechanical requirements. Aerodynamic considerations have resulted in somewhat similar shapes for lighter-than-air vehicles such as dirigibles and blimps. Where significant velocity through the fluid medium is required, the art seems to have settled on a generally tubular shape, rounded at the front and tapering toward the rear with the diameter made as small as the internal mechanism and/or flotation requirements will permit to minimize frontal area. This general configuration has been evident in the usual configuration of airships, of manned submarine vehicles, and of unmanned vehicles such as torpedoes. The power required to drive such a vehicle through the fluid medium varies with factors such as the effective frontal area, skin friction, and drag caused by separation of the flow over the surface of the body resulting in turbulence. A conventional way of avoiding flow separation over the rearward surfaces of such vehicles is to provide a tapering surface free of abrupt discontinuities with a propeller or impeller at or toward the rear.

The disadvantages of such structure are that the tapered configuration reduces internal volume while requiring a lengthening of the hull. Further, the control surfaces are located such that actuators therefor, as well as the propeller shaft, must, in part at least, be located where the hull approaches minimum diameter. Thus the traditional shape is volume inefficient, thereby reducing pay load, and makes it inconvenient to adapt the power plant and drive train. Another disavantage of the conventional configuration is that the control fins are normally located in a region where the flow past the fins actually slows in velocity, thus necessitating somewhat larger fins to compensate. And it will be appreciated that the combination of the larger fins and the elongated tapering rear section makes for a somewhat fragile structure, as compared with vehicles having shorter bodies and/or with smaller fins.

SUMMARY OF THE INVENTION

The boundary layer problems referred to above can be avoided through the use of the rearwardly tapering structure but at the cost of the disadvantages set forth above. The streamline flow can also be held in attached to the rear of a vehicle having a comparatively bluff, or stubby, afterbody if an actuator disc type propeller is incorporated at the rear which is of such dimensions and configuration as to pull a substantial part of the boundary layer flow through itself and, in doing so, acts as a jet pump to also cause the streamlines to follow the configuration of the hull closely and not become detached. The clearance from the tips of the propeller to the most nearly adjacent part of the afterbody is, or may be, a critical dimension in causing the desired part of the boundary to flow through the propeller. This clearance will vary somewhat with the configuration of the afterbody, the general size and configuration of the vehicle forward of the afterbody, etc. With this arrangement, if separation begins to occur, the propeller will promptly exhaust the dead or inactive fluid and reestablish the attached flow pattern. As the propeller inducts a large part of the boundary layer, it adds sufficient energy to restore its downstream velocity to just over the free stream velocity. this results in a nearly "wakeless" propulsion where the wake is left with little or no absolute velocity. It appears that the system is optimized when about half or more of the boundary layer is inducted.

In the case of a hull having a bluff afterbody, the nature of the flow is different from, the flow over the tapered afterbody of a traditional hull in that the water is actually moving faster than free stream in the region of control fins placed just ahead of the propeller. Thus the fins are more effective than the usual fins which are located in a region of potential flow slow-down and may, therefore, be smaller.

Where a single propeller is used it is useful to also include a plurality of stator blades, preferably located between the fins and the inlet to the propeller, which re angled to oppose the torque effects of the propeller.

DESCRIPTION OF THE DRAWINGS

FIG. 1 is a side view, partly in section, of the rear section of an underwater vehicle according to my invention;

FIG. 2 is a view from the rear of the vehicle of FIG. 1;

FIG. 3 is a schematic view of a part of the vehicle of FIG. 1 shown in relation to the fluid medium in which it operates.

DESCRIPTION OF THE PREFERRED EMBODIMENTS

Referring now to FIG. 1, the rear section of an underwater vehicle such as a torpedo is shown including a hull 10 containing a propulsion electric motor 12 which drives a propeller 14 through a planetary gear reduction box 15. Propeller 14 is not a conventional marine screw type but is of a type shown in the art as an "actuator disc", being quite thin or narrow in the axial dimension and having a comparatively large number of blades. This type of blade, which is well known to hydrodynamicists, is discussed in an article entitled "The Screw Propeller" by E. Eugene Larrabee appearing in *Scientific American* for July 1980. A plurality of control fins 16, typically four, six or eight, are attached to the hull and supported on shafts 18 having gears 20 which are driven by servomotors 22. The servomotors are actuated from a guidance system (not shown) forming no part of the present invention but which would normally include means for avoiding hunting or diverging oscillations in yaw and pitch. A plurality of adjustable stators 24 are positioned at the rear of the hull 10 such that they are in the fluid flow path between the control fins 16 and the propeller 14. A large hub on the axis of propeller 14 assists in directing the fluid smoothly aft from the housing 10. The diameter of propeller 14 is approximately one-half to three-fourths of the diameter of the hull 10.

FIG. 2 shows the vehicle of FIG. 1 as seen from the rear including housing 10 and the propeller 14. Also visible in this view are the four control fins 16 and a plurality of stator control surfaces 24 which are stationary or adjustable as desired to direct the flow such as to counter the torque produced by the propeller 14 which tends to cause said housing to roll. Some or all of said stator control surfaces 24 may be movable as by an automatic navigation system to provide roll stabilization. Also, as an alternative, the control fins 16 may be steerable differentially to effect or assist in effecting roll stabilization.

FIG. 3 is a schematic view of a part of the vehicle of FIG. 1 shown in relation to the fluid medium in which it operates. The hull 10 is shown moving through a boundary layer of water generally defined by the several lines parallel to hull 10 and which flow past control fin 16, stator 24, and propeller 14. At point B on the surface of hull 10 is shown a velocity diagram indicating the relative velocity of the water through which the hull is moving in comparison to the distance away from the surface of the hull. As would be expected, the drag from, the surface of hull 10 causes the adjacent layers of water to flow with it, resulting in a very low relative velocity. The relative velocity increases with greater distance from the hull out to the limit of the boundary layer, after which further distance shows no change in relative velocity. The attached flow over the bluff corner (or shoulder) of the afterbody where the fins 16 are located is caused to accelerate in this region, and thus the fins are in a region of higher than free stream relative velocity $V_F$ in the region A of the control fin 16. This makes the fins 16 more effective for a given area than fins located at the end of a tapered body which are in an area of potential reduction in velocity. The propeller 14, if properly designed, can effectively supply the momentum deficiency in the velocity profile, thus providing a downstream velocity profile which is like that shown at C which is, ideally, a straight line. This, of course, represents an ideal case and maximum efficiency. To the extent that propeller design, etc., can approach this ideal, the resulting wake will be minimal.

It will therefore be appreciated that the present invention makes it possible to design waterborne vehicles which are more volume-efficient than conventional tapered configurations and which greatly simplify the inclusion of the propulsion and control means.

What is claimed:

1. A self-propelled vehicle for efficient, high speed movement through a fluid medium including a generally cylindrical housing, a propeller external of said housing, an energy source and power means in said housing connected to said energy source for driving said propeller, said propeller being to the rear of said vehicle, and a plurality of control fins located at the rear of said housing;

wherein the invention comprises forming said housing with a rounded bluff afterbody, forming said propeller of the actuator disc type and of approximately half to three-fourths of the diameter of said housing with a hub of substantial diameter adjacent said housing and tapering to the rear to assist in assuring attached flow over said housing, the spacing between the tips of the blades of said propeller and the nearest part of said afterbody being dimensioned such that substantially half or more of the boundary layer flow is inducted into said propeller, attaching a plurality of stator control surfaces to said afterbody between said fins and said propeller and placing said control fins just ahead of the rear surface of said housing at the shoulder of said afterbody such that they are located in an area where the free stream velocity of the surrounding fluid is essentially as high as or higher than free stream velocity.

2. A vehicle as set forth in claim 1 wherein said stator control surfaces are adjustable to counter the torque produced by said propeller.

3. A vehicle as set forth in claim 2 wherein at least some of said stator control surfaces are controllable to provide roll stabilization.

4. A vehicle as set forth in claim 2 wherein at least some of said control fins are steerable differentially to effect roll stabilization.

* * * * *